US006868893B2

(12) United States Patent
Shimohata et al.

(10) Patent No.: US 6,868,893 B2
(45) Date of Patent: Mar. 22, 2005

(54) METHOD AND APPARATUS FOR DIRECTIONALLY SOLIDIFIED CASTING

(75) Inventors: Sachio Shimohata, Takasago (JP); Yuichi Ohtani, Takasago (JP); Tatsuya Ohira, Yokohama (JP); Ikuo Okada, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/305,196

(22) Filed: Nov. 27, 2002

(65) Prior Publication Data

US 2003/0141035 A1 Jul. 31, 2003

(30) Foreign Application Priority Data

Dec. 21, 2001 (JP) ..... 2001-390542

(51) Int. Cl.[7] ..... B22D 27/04

(52) U.S. Cl. ..... 164/122.1; 164/122.2; 164/338.1

(58) Field of Search ..... 164/122.1, 122.2, 164/338.1

(56) References Cited

U.S. PATENT DOCUMENTS

| | | | | |
|---|---|---|---|---|
| 5,778,961 A | | 7/1998 | Hugo et al. | |
| 5,921,310 A | | 7/1999 | Kats et al. | |
| 6,206,081 B1 | * | 3/2001 | Chiang et al. | 164/338.1 |
| 6,209,618 B1 | | 4/2001 | Chiang | |

FOREIGN PATENT DOCUMENTS

| | | | |
|---|---|---|---|
| DE | 196 02 554 | | 9/1997 |
| EP | 0 749 790 | | 12/1996 |
| EP | 1 162 016 | | 12/2001 |
| JP | 09-010919 | | 1/1997 |
| JP | 09-206918 | | 8/1997 |
| WO | WO 01/07185 | * | 2/2001 |
| WO | WO 01/26850 | * | 4/2001 |

* cited by examiner

*Primary Examiner*—Kuang Y. Lin
(74) *Attorney, Agent, or Firm*—Oblon, Spivak, McClelland, Maier & Neustadt, P.C.

(57) ABSTRACT

Provided is a directional solidification casting apparatus capable of heightening a cooling effect when molten material poured in a mold is directionally solidified. A mold (20) disposed around a predetermined area is drawn out from a heating chamber (10) heated above a melting temperature of metals for producing a casting (31), and molten metals (32) held in a cavity (21) of the mold (20) are directionally solidified. The directional solidification casting apparatus (100) comprises a driving rod (42) by which the mold (20) is drawn out from the heating chamber (10), a gas nozzle (52*b*) through which a cooling gas is jetted from inside a predetermined area where the mold (20) is disposed so as to rapidly cool the mold (20), and a gas nozzle (52*a*) through which a cooling gas is jetted from outside the predetermined area where the mold (20) is disposed so as to rapidly cool the mold (20). A baffle (15) that does not move even when the driving rod (42) moves up and down is additionally provided. The baffle (15) blocks radiant heat emitted from the heating chamber (10).

5 Claims, 8 Drawing Sheets

METHOD AND APPARATUS FOR DIRECTIONALLY SOLIDIFIED CASTING

BACKGROUND OF THE INVENTION

1. Field of the Invention

This invention relates to a method for producing a unidirectionally solidified casting and an apparatus for producing the same, and, more particularly, to a directional solidification casting method for casting a stationary blade, a rotor blade or the like such as that of a gas turbine, and an apparatus for casting the same.

2. Description of the Related Art

Conventionally, a Bridgeman method has been used to produce a casting that has a part onto which a great thermal and mechanical load is imposed. A stationary blade or a rotor blade of a gas turbine formed intricately can be mentioned as one example of such a part. A casting directionally solidified according to the Bridgeman method exhibits single crystals or columnar crystals oriented in advantageous directions.

A description will be given of a conventional method for producing a directionally solidified casting with reference to FIG. 8. A directionally solidified casting has been conventionally produced such that, as shown in FIG. 8, a driving rod 42 is lowered in the direction of an arrow along axial line A—A, and a mold 20 placed on a cooling plate 41 is drawn out from a heating chamber 10. When molten metal 32 in the mold 20 passes through a water-cooled ring 51, the metal 32 is cooled by radiational cooling, etc., and is solidified into a casting 31. Instead of the method using the water-cooled ring 51 shown in the figure, another cooling method has also been employed in which cooling gas is jetted onto the mold 20.

Still another cooling method, such as a cooling bath method or a method in which the mold 20 is placed into a heat conduction pipe, has been employed.

Art disclosed in Japanese Patent Provisional Publication Nos. 9-10919/1997 and 9-206918/1997, etc., is known as the directional solidification casting method and apparatus described above.

SUMMARY OF THE INVENTION

The aforementioned method and apparatus have been conventionally employed to produce a directionally solidified casting.

However, in the directional solidification achieved by the conventional method and apparatus, there is a case where a structural defect called "anisotropic crystals" or a structural defect called "freckle" occurs if the shape of a part to be cast is complex, or if a method by which a plurality of products are produced by carrying out a one-time casting process is employed. This structural defect brings about a decrease in yield. Additionally, if a casting is enlarged, cooling efficiency will decline, and therefore the production efficiency of the casting will decline.

For example, the method and the apparatus shown in FIG. 8 do not have a mechanism for blocking heat radiation from a heater 11.

In this structure, part of the radiant heat from the heater 11 is repeatedly reflected without being absorbed into the mold 20 in a space formed in the interior of the mold 20, and reaches a cooling zone. This radiant heat reaches the cooling zone through a hollow part of the heating chamber 10 also in the drawing-out and cooling processes of the mold 20.

Most of the radiant heat from the heater 11 is discharged to the cooling zone without being blocked, and therefore the cooling of the molten metal 32 in the mold 20 in the cooling zone is not promoted, and, in addition, the thermal efficiency of the whole of the directional solidification casting apparatus 100 deteriorates. A deterioration in the thermal efficiency not only has a cause from which a structural defect occurs, but also raises a concern that a decrease in production efficiency will be caused.

In the method and the apparatus disclosed in Japanese Patent Provisional Publication No. 9-10919/1997, the yield or productivity deteriorates since the number of molds that can be cooled is only one. In the method and the apparatus disclosed in Japanese Patent Provisional Publication No. 9-206918/1997, although a plurality of molds can be cooled at one time, the molds are cooled only by radiational cooling, and therefore the entire cooling amount does not increase, so that large-scale casting cannot be produced.

It is therefore an object of the present invention to provide a directional solidification casting method and a directional solidification casting apparatus capable of heightening a cooling effect and capable of improving productivity when molten material poured in a mold is directionally solidified.

In order to achieve the object, the present invention provides a directional solidification casting apparatus characterized by the following structure. That is, the directional solidification casting apparatus for directionally solidifying molten metal supplied to a plurality of molds by drawing out the plurality of molds disposed around a predetermined area from a heating chamber heated at or above a melting temperature of the metal to be cast comprises a driver by which the plurality of molds are drawn out from the heating chamber, a first cooler by which the plurality of molds are cooled from inside of the predetermined area with a cooling gas, and a second cooler by which the plurality of molds are cooled from outside of the predetermined area with a cooling gas.

The directional solidification casting apparatus of the present invention has a plurality of molds disposed around a predetermined area. For example, the predetermined area may be a circular area. In the circular area, the plurality of molds are disposed on its circumference. The plurality of molds can be cooled with a cooling gas from the first cooler from a center side of the circle and with a cooling gas from the second cooler from outside of the circle. Therefore, a sufficient cooling effect can be obtained for directional solidification, and sufficient productivity can be secured. Besides a circle, polygons such as a triangle and a rectangle, or various indeterminate forms may be used as the predetermined area.

The directional solidification casting apparatus may further comprise a baffle that is disposed at the lower part of the heating chamber and the upper part of the first and second coolers. The baffle has an opening through which the plurality of molds pass. The baffle is disposed at the lower part of the heating chamber and at the upper part of the first and second coolers even when the plurality of molds are drawn out from the heating chamber, and the baffle blocks heat emitted from a heat source of the heating chamber. A cooling effect achieved by the first and second coolers and thermal efficiency of the directional solidification casting apparatus can be heightened by allowing the baffle to block the heat from the heat source.

Herein, the directional solidification casting apparatus of the present invention may have at least four aspects mentioned below.

A first aspect of the directional solidification casting apparatus is one in which the first and second coolers blow a cooling gas so as to strike the mold. A second aspect is one in which the first and second coolers blow a cooling gas along the outer periphery of the mold. A third aspect is one in which the first and second coolers jet a cooling gas from a perforated pipe.

A fourth aspect is one in which the first and second coolers jet a cooling gas from a gas port formed in the inner circumferential surface of a ring-shaped tube disposed so as to surround the outer periphery of the mold. In the fourth aspect, if the ring-shaped tube is an independent single body, a part of the ring-shaped tube which cools the mold from an inner side can be set to be the first cooler, and a part of the ring-shaped tube which cools the mold from an outer side can be set to be the second cooler. If the ring-shaped tube is made up of two divided bodies, one of the bodies can be set to be the first cooler, and the other one can be set to be the second cooler. It is permissible to form the tube so as to have a plurality of divided bodies.

In the present invention, according to these four aspects, the mold can be quickly cooled from the inside and outside of the mold disposed around the predetermined area.

The directional solidification casting apparatus may further comprise a first radiational cooler, passing through the driver, for absorbing radiant heat from the plurality of molds from the inside of the driver and cooling them when the plurality of molds are lowered by the driver; and a second radiational cooler, disposed outside the first radiational cooler, for absorbing radiant heat from the plurality of molds from the outside of the driver and cooling them when the plurality of molds are lowered by the driver. Thus, a mold quickly cooled when the mold passes through the first and second coolers can be further cooled by the first and second radiational coolers.

The present invention may further provide a directional solidification casting method as follows. That is, provided is the directional solidification casting method for directionally solidifying molten metal supplied to a plurality of molds by drawing out the plurality of molds disposed around a predetermined area from a heating chamber heated at or above a melting temperature of the metal to be cast, comprising steps of drawing out the plurality of molds from the heating chamber, while blocking heat from the heating chamber; and blowing an inert gas from inside and outside of the plurality of molds disposed around the predetermined area, thereby directionally solidifying the molten metal.

The inert gas can be atomized liquid nitrogen or an evaporated gas of liquid nitrogen. The inert gas is not limited to the liquid nitrogen, and another fluid may be used as long as it is an inert gas that does not chemically react with the mold.

The inert gas may be characterized by being planarly blown onto the mold. When planarly blown, the inert gas may be intended to be blown from a perforated pipe, but the gas may be blown from a single nozzle or from a plurality of nozzles toward the mold, or the gas may be blown from a ring-shaped tube surrounding the mold toward the mold.

As described above, according to the present invention, it is possible to provide the directional solidification casting apparatus and the directional solidification casting method capable of heightening a cooling effect when molten material is directionally solidified. The productivity of a directionally solidified casting can be improved by the directional solidification casting apparatus and method described as above.

Additionally, since the molten material can be rapidly cooled when it is directionally solidified, it is possible to heighten the inclination degree of a temperature gradient in a vertical direction and prevent a structural defect from occurring. Still additionally, it is possible to reduce a temperature gradient in a horizontal direction by rapid cooling and improve cooling homogeneity.

DETAILED DESCRIPTION OF THE PREFERRED EMBODIMENTS

First Embodiment

The present invention will hereinafter be described in detail based on the first embodiment shown in the attached drawings.

Figure 1:
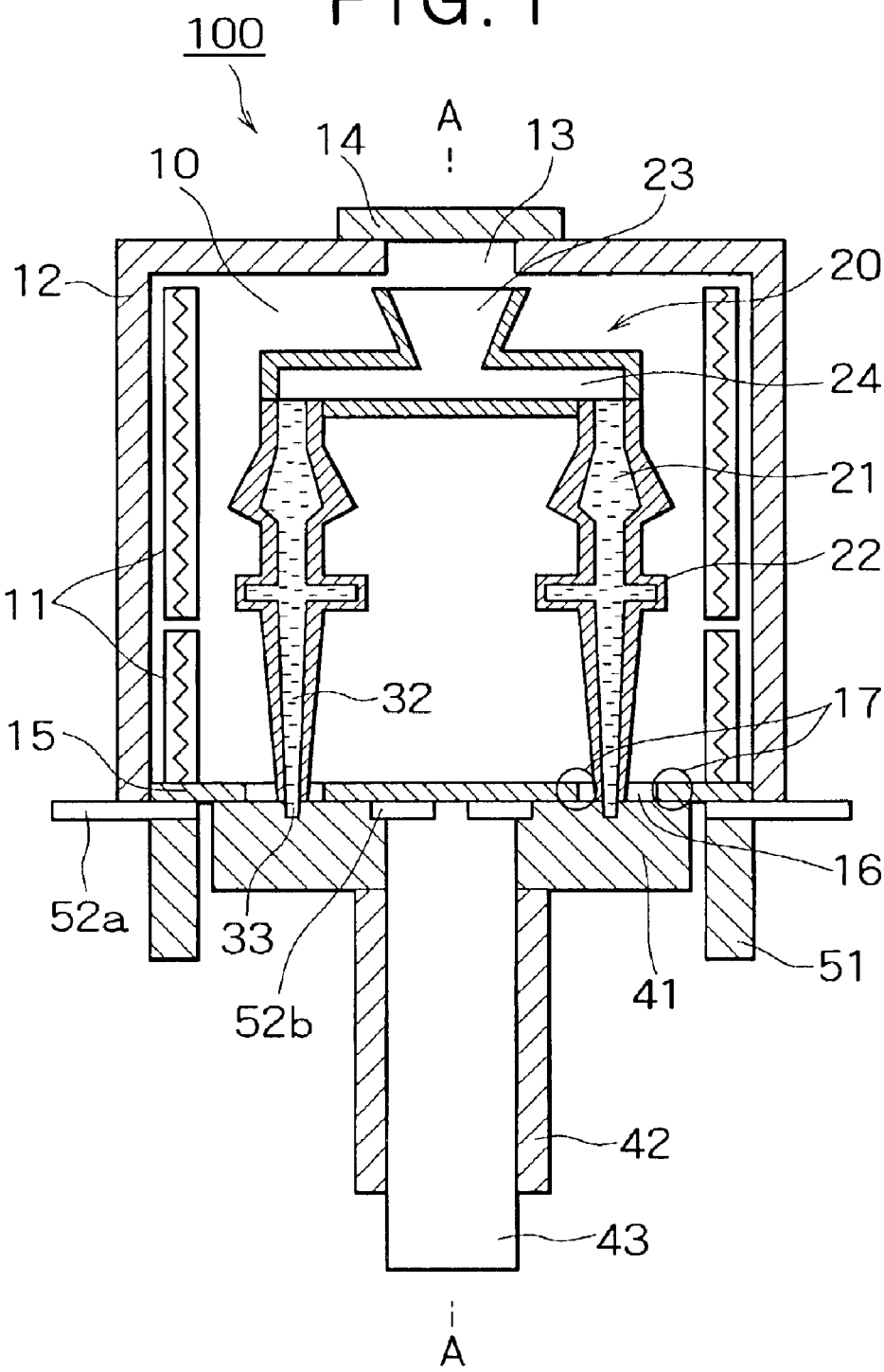
FIG. 1 shows the structure of a directional solidification casting apparatus 100 in a first embodiment.

FIG. 1 shows the structure of a directional solidification casting apparatus 100 in the first embodiment. Herein, a description will be given of a case where a blade, such as that of a turbine, is cast by directional solidification. A plane cross-sectional view of the directional solidification casting apparatus 100 is shown in FIG. 3 when cut along line B—B in a cooling process described later with reference to FIG. 2. In other words, in the directional solidification casting apparatus 100 described in the first embodiment, a plurality of blades (four blades in the figure) can be cast as shown in FIG. 3.

As shown in FIG. 1, a heating chamber 10 of the directional solidification casting apparatus 100 is surrounded by a cover 12, excluding its bottom face. A heater 11 is disposed on the inner side face of the cover 12 of the heating chamber 10. An opening 13 is formed in the top face of the cover 12. An opening lid 14 with which the opening 13 is covered is provided. A baffle 15 having an opening 16 is disposed at the bottom of the heating chamber 10. A flexible finger 17 is provided at the end of the baffle 15 so as to contact with the side face of a mold 20 when the mold 20 is drawn out from the heating chamber 10.

The mold 20 is contained in the heating chamber 10. The mold 20 has pouring port 23 from which molten metal is poured and passage 24 through which the molten metal poured from the pouring port 23 is supplied to cavity 21. Thin ceramic portion 22 for containing, e.g., nucleuses by which crystal growth is promoted is provided at the intermediate portion of the mold 20.

The mold 20 is placed on cooling plate 41. The cooling plate 41 closes the lower part of the cavity 21 and forms the bottom of the mold 20. The cooling plate 41 further closes the opening 16 of the baffle 15. The cooling plate 41 is supported by driving rod 42 capable of moving up and down along the axial line A—A, and can draw out the mold 20 placed on the cooling plate 41 from the heating chamber 10 in response to the lowering of the driving rod 42. Heat sink 43 is disposed in the driving rod 42. When the driving rod 42 is lowered, the heat sink 43 is fixed at the same position, and cools the mold 20 drawn out from the heating chamber 10 from a center side (from the side of the axial line A—A) of the directional solidification casting apparatus 100 by radiational cooling.

The directional solidification casting apparatus 100 also has a water-cooled ring 51 used for cooling the mold 20 from the side of the outer periphery of the apparatus 100 by radiational cooling, and gas nozzles 52*a* and 52*b* through which atomized liquid nitrogen or an evaporated gas of liquid nitrogen (hereinafter, referred to as "pressure gas") is jetted. The gas nozzle 52*a* is disposed between the baffle 15 and the water-cooled ring 51 as shown in FIG. 3, and cools the mold 20 from the side of the water-cooled ring 51 (i.e., from the outer periphery side). The gas nozzle 52*b* is disposed between the baffle 15 and the heat sink 43 as shown in FIG. 3, and cools the mold 20 from the side of the center (i.e., from the inner periphery side). Since the baffle 15 and the gas nozzles 52*a* and 52*b* are fixed, they never move even when the driving rod 42 moves up and down.

The directional solidification casting apparatus 100 in the first embodiment has a cooling zone made up of the gas nozzles 52*a* and 52*b*, the cooling plate 41, the heat sink 43, and the water-cooled ring 51 as described above. Let it be considered that the cooling zone and the driving rod 42 disposed at the lower part of the heating chamber 10 are surrounded by a casing not shown.

The interior of the heating chamber 10 is heated by the heater 11 disposed in the heating chamber 10, and is kept at a higher temperature than the melting temperature of the molten metal 32. The molten metal 32 is poured from the opening 13 formed in the cover 12 to the pouring port 23 in a state where the heating chamber 10 is sufficiently heated. The molten metal 32 is supplied to the cavity 21 through the passage 24, and comes in contact directly with the cooling plate 41 forming the bottom of the mold 20. Accordingly, the heat of the molten metal 32 is transmitted to the cooling plate 41 by heat conduction. Thereafter, the molten metal 32 is cooled and directionally solidified, so that a solidified front 33, which is a thin alloy, is formed at the bottom of the cavity 21. A large temperature gradient is formed between the upper molten metal 32 and the lower cooling plates 41 with the solidified front 33 therebetween.

Figure 2:
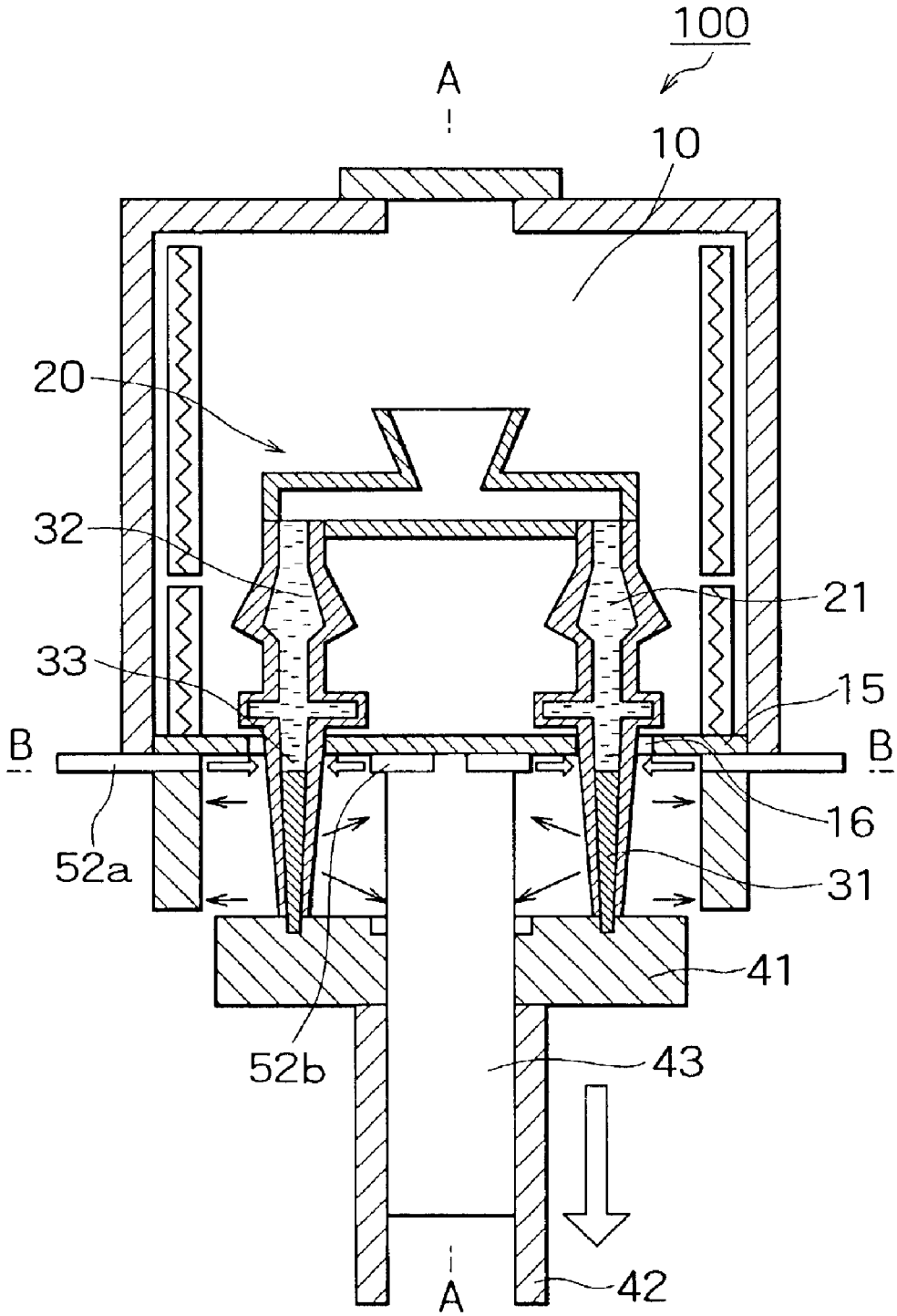
FIG. 2 shows a cooling process in the directional solidification casting apparatus 100 in the first embodiment.
Figure 3:
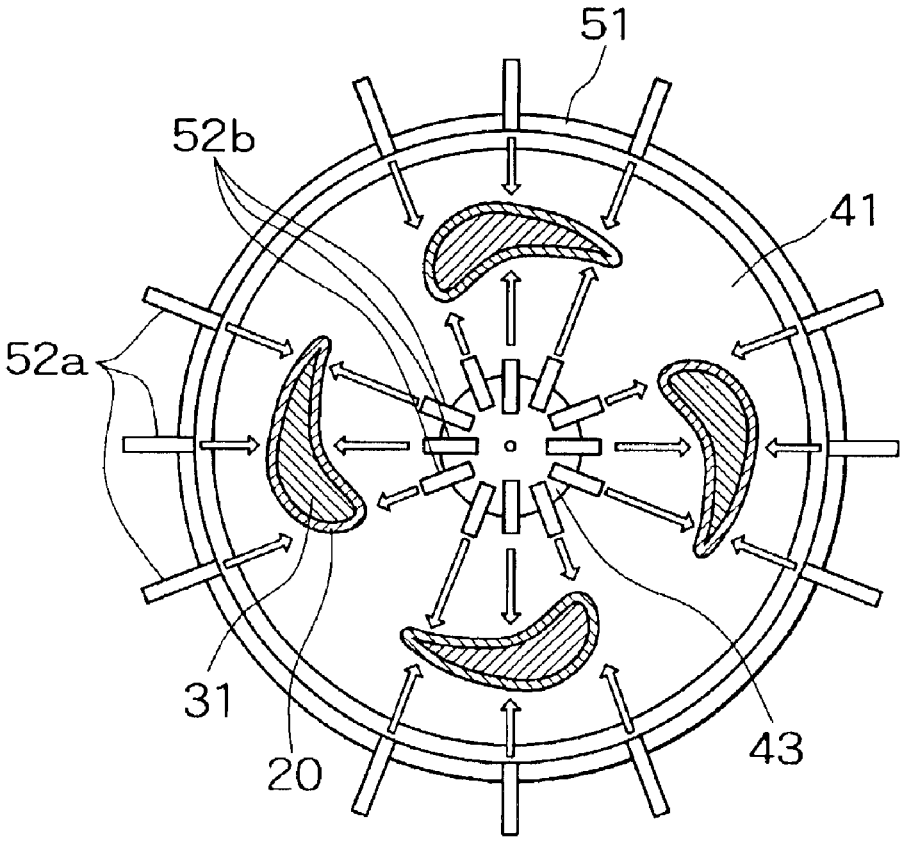
FIG. 3 is a plane cross-sectional view of the directional solidification casting apparatus 100 in the first embodiment.

FIG. 2 shows a cooling process in the directional solidification casting apparatus 100 in the first embodiment. As shown in FIG. 2, the cooling plate 41 is lowered in response to the lowering of the driving rod 42 along the axial line A—A. When lowered, the mold 20 placed on the cooling plate 41 passes through the opening 16 formed in the baffle 15, and is drawn out from the heating chamber 10.

As described above, the gas nozzle 52*a* through which a pressure gas is jetted is disposed at the lower part of the baffle 15 at the outer periphery side, i.e., at the side of the outer periphery of the mold 20. The gas nozzle 52*b* through which a pressure gas is jetted is disposed at the lower part of the baffle 15 at the inner periphery side, i.e., at the side of the inner periphery of the mold 20. When the mold 20 holding the hot molten metal 32 in the cavity 21 passes by the gas nozzle 52*a*, a pressure gas is jetted onto the mold 20 from the gas nozzle 52*a* as shown by the arrow. Simultaneously, a pressure gas is jetted onto the mold 20 from the gas nozzle 52*b* as shown by the arrow. Not only the mold 20 but also the molten metal 32 held in the cavity 21 of the mold 20 is rapidly cooled by jetting the pressure gas thereonto. The rapid cooling by the pressure gas is carried out simultaneously both from the outer periphery side and from the inner periphery side of the mold 20.

When the molten metal 32 is supplied to the cavity 21, the solidified front 33 formed at the bottom of the mold 20 forms an interface between the molten metal 32 and the casting 31 at the position of the line B—B of the lower part of the gas nozzles 52*a* and 52*b*. The solidified front 33 stays at the position of the line B—B even when the mold 20 is lowered, and the casting 31 below this line is solidified. The casting 31 emits heat toward the water-cooled ring 51 disposed at the outer periphery side of the mold 20 and toward the heat sink 43 disposed at the inner periphery side of the mold 20 as shown by the arrows, and is further cooled.

Accordingly, the molten metal 32 supplied to the cavity 21 is directionally solidified by rapidly cooling the mold 20. The temperature gradient in the horizontal direction of the casting 31 that has been directionally solidified in the cavity 21 can be reduced as much as possible by rapidly cooling the mold 20 from the outer periphery side and from the inner periphery side. Additionally, since the inclination of the temperature gradient in the vertical direction can be enlarged, directional solidification having no structural defect can be carried out. Thereby, productivity by the directional solidification casting apparatus 100 is improved.

FIG. 3 is a plane cross-sectional view of the directional solidification casting apparatus 100 in the first embodiment. The plane cross-sectional view of FIG. 3 shows a state where the directional solidification casting apparatus 100 of FIG. 2 is cut along the line B—B.

As shown in FIG. 3, the mold 20 is disposed in a predetermined area in such a way so as to surround the heat sink 43. The water-cooled ring 51 is disposed at the outer periphery side of the mold 20, and, together with the heat sink 43 disposed at the inner periphery side, absorbs radiant heat from the mold 20, and cools the mold 20. Pressure gas striking the mold 20 is jetted from the gas nozzle 52*a* disposed at the outer periphery side of the area where the mold 20 is disposed (i.e., at the side of the water-cooled ring 51) shown by the arrows. Likewise, pressure gas striking the mold 20 is jetted from the gas nozzle 52*b* disposed at the inner periphery side of the area where the mold 20 is disposed (i.e., at the side of the heat sink 43) shown by arrows. The molten metal 32 held in the cavity 21 of the mold 20 as well as the mold 20 is rapidly cooled by this pressure gas, and is directionally solidified into the casting 31. Thereafter, the casting 31 in the mold 20 is cooled by radiational cooling while the mold 20 is emitting heat toward the heat sink 43 and toward the water-cooled ring 51.

As described above, in the first embodiment, the mold 20 is rapidly cooled by the pressure gas jetted from the gas nozzle 52*a* disposed outside the area where the molds 20 are disposed and from the gas nozzle 52*b* disposed inside the area where the molds 20 are disposed when the molds 20 are drawn out from the heating chamber 10, and thereby the molten metal 32 is directionally solidified. A cooling effect obtained when the molten metal 32 is directionally solidified can be heightened by constructing the directional solidification casting apparatus 100 in this way and by allowing the pressure gas from the gas nozzles 52*a* and 52*b* to rapidly cool the mold 20. Additionally, heat emitted from the heater 11 can be blocked by the baffle 15 disposed at the middle of the bottom of the heating chamber 10 when the mold 20 and the cooling plate 41 are lowered. Therefore, not only can a cooling effect achieved below the gas nozzles 52*a* and 52*b* be heightened, but also the thermal efficiency of the whole of the directional solidification casting apparatus 100 can be improved.

Additionally, according to the first embodiment, the mold 20 by which a plurality of castings 31 are directionally solidified in a one-time casting process can be efficiently cooled, and the molten metal 32 can be directionally solidified. Still additionally, since rapid cooling can be carried out by the pressure gas jetted from the gas nozzles 52*a* and 52*b*, the casting 31 that has been directionally solidified does not easily generate structural defects even if it is a portion having a complex shape.

Atomized liquid nitrogen or an evaporated gas of liquid nitrogen is used as the pressure gas jetted from the gas nozzles 52*a* and 52*b* in the first embodiment. However, if it is inert material that does not chemically react with the heated mold 20, another inert fluid, such as helium or argon, may be jetted therefrom.

Second Embodiment

Figure 4:
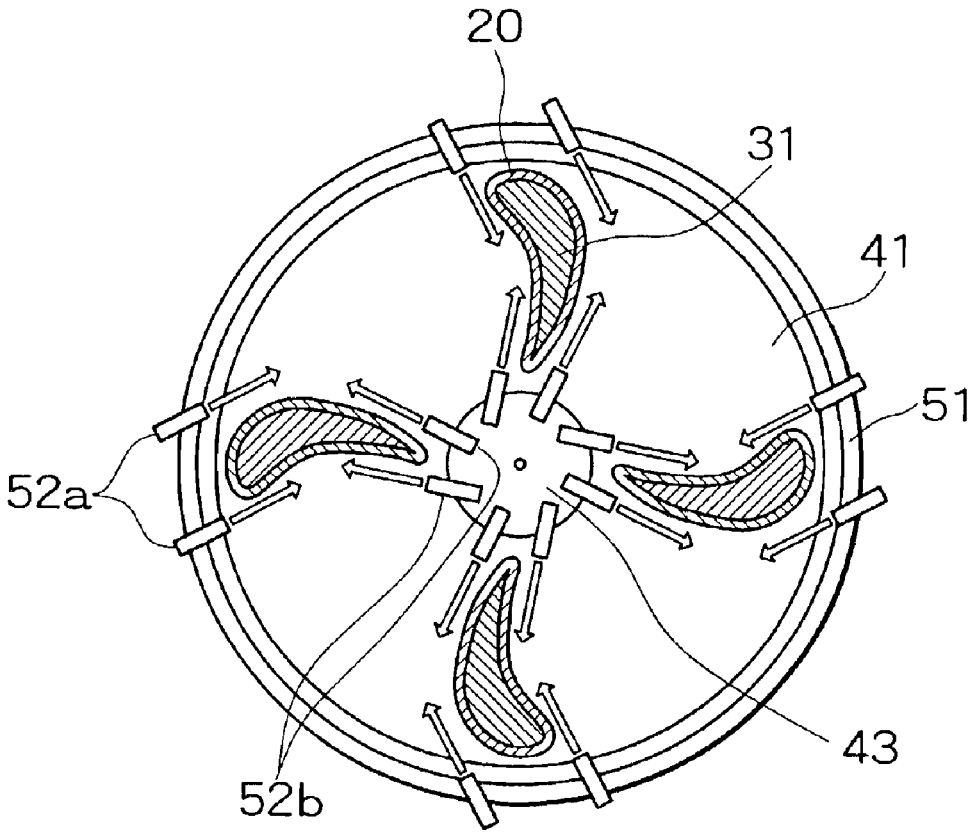
FIG. 4 is a plane cross-sectional view of the directional solidification casting apparatus 100 in a second embodiment.

A second embodiment will hereinafter be described with reference to FIG. 4. FIG. 4 is a plane cross-sectional view of the directional solidification casting apparatus 100 in the second embodiment. The plane cross-sectional view of FIG. 4 shows a state where the directional solidification casting apparatus 100 described in the first embodiment is cut along the line B—B like the plane cross-sectional view of FIG. 3. Except for the directions of the gas nozzles 52*a* and 52*b*, the directional solidification casting apparatus 100 in the second embodiment is structured in the same way so as in the directional solidification casting apparatus 100 described in the first embodiment, and therefore a description thereof is omitted.

As shown in FIG. 4, the mold 20 is disposed in a predetermined area in such a way so as to surround the heat sink 43. The water-cooled ring 51 is disposed at the side of the outer periphery of the mold 20, and, together with the heat sink 43 disposed at the inner periphery side, absorbs radiant heat from the mold 20, and cools the mold 20. Pressure gas is jetted along the outer periphery of the mold 20 from the gas nozzle 52*a* disposed at the outer periphery side of the area where the mold 20 is disposed (i.e., at the side of the water-cooled ring 51) as shown by the arrows. Likewise, pressure gas is jetted along the outer periphery of the mold 20 from the gas nozzle 52*b* disposed at the inner periphery side of the area where the mold 20 is disposed (i.e., at the side of the heat sink 43) as shown by arrows. The molten metal 32 held in the cavity 21 of the mold 20 as well as the mold 20 is rapidly cooled by this pressure gas, and is directionally solidified into the casting 31.

As described above, in the second embodiment, the mold 20 is rapidly cooled by the pressure gas jetted from the gas nozzle 52*a* disposed outside the area where the molds 20 are disposed and from the gas nozzle 52*b* disposed inside the area where the molds 20 are disposed, and thereby the molten metal 32 is directionally solidified. Thus, the same effect as in the first embodiment can be obtained in the second embodiment.

Third Embodiment

A third embodiment will hereinafter be described with reference to FIG. 5.

Figure 5:
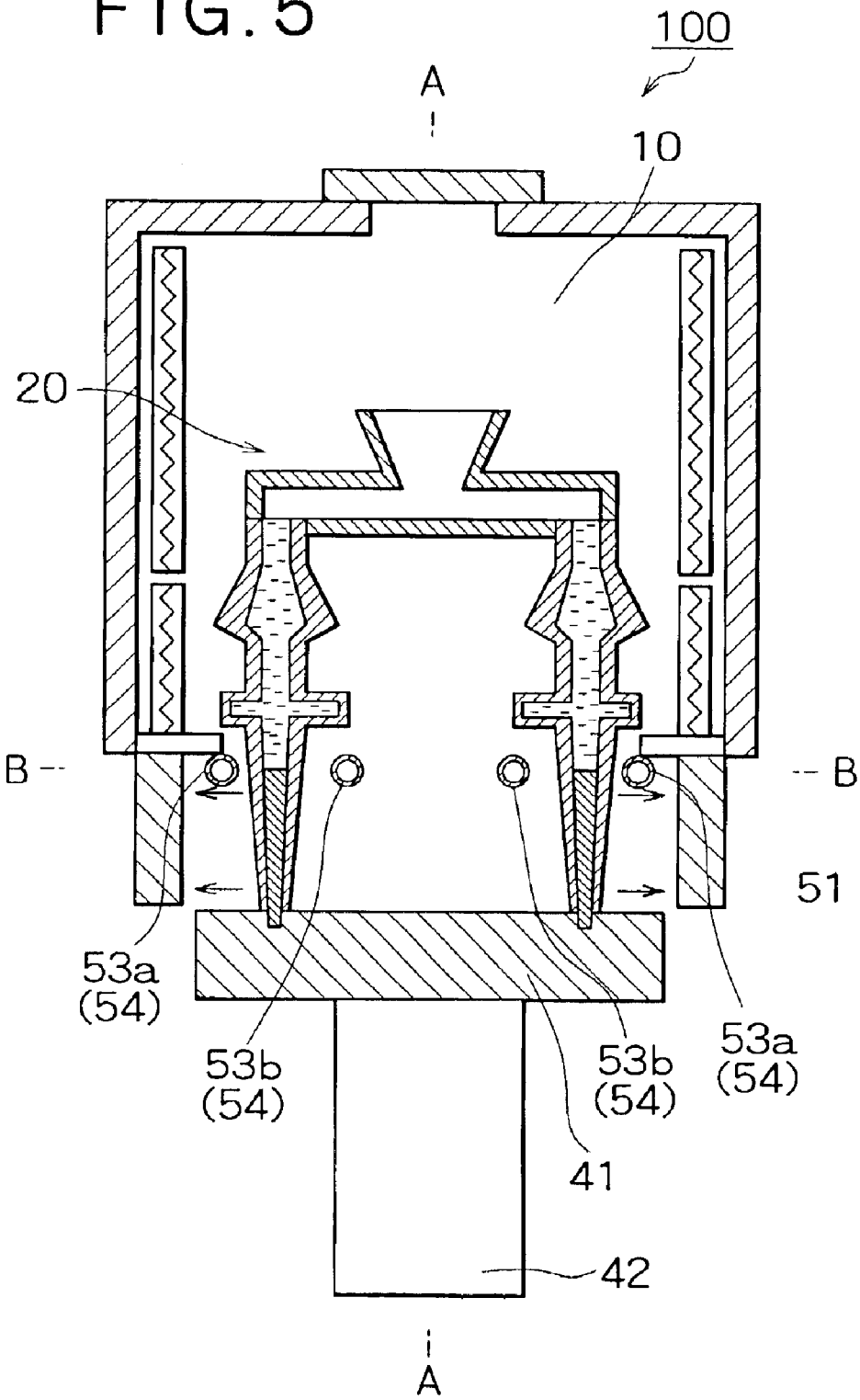
FIG. 5 shows the structure of the directional solidification casting apparatus 100 in a third embodiment.

FIG. 5 shows the structure of the directional solidification casting apparatus 100 in the third embodiment. This directional solidification casting apparatus 100 has almost the same structure as those in the first and second embodiments. In this directional solidification casting apparatus 100, the mold 20 placed on the cooling plate 41 is drawn out from the heating chamber 10 by lowering the driving rod 42 along the axial line A—A. Instead of the gas nozzles 52*a* and 52*b* described in the first and second embodiments, a perforated pipe 53*a* and a perforated pipe 53*b* for cooling the mold 20 are provided. The water-cooled ring 51 is disposed at the lower part of the heating chamber 10.

Figure 6:
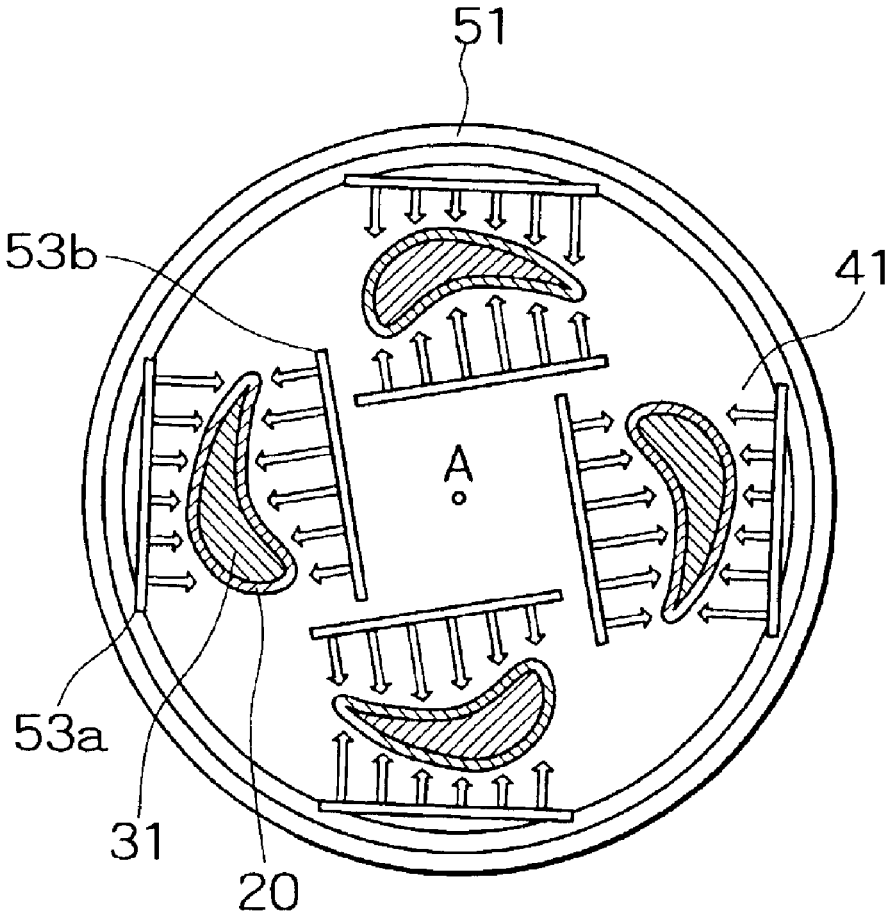
FIG. 6 is a plane cross-sectional view of the directional solidification casting apparatus 100 in the third embodiment.

FIG. 6 is a plane cross-sectional view of the directional solidification casting apparatus 100 in the third embodiment. The plane cross-sectional view of FIG. 6 shows a state where the directional solidification casting apparatus 100 of FIG. 5 is cut along the line B—B.

As shown in FIG. 6, the mold 20 is disposed in a predetermined area in such a way so as to surround the axial line A—A. The water-cooled ring 51 is disposed at the side of the outer periphery of the mold 20, and absorbs radiant heat from the mold 20, thereby cooling the mold 20. A pressure gas is jetted from the inner circumferential surface of the perforated pipe 53*a* disposed at the side of the outer periphery of the area where the mold 20 is disposed (i.e., at the side of the water-cooled ring 51) as shown by the arrows. A pressure gas is jetted from the outer circumferential surface of the perforated pipe 53*b* disposed at the side of the inner periphery of the area where the mold 20 is disposed (i.e., at the side of the axial line A—A) as shown by the arrows. The molten metal 32 in the mold 20 is rapidly cooled by this pressure gas, and is directionally solidified into the casting 31. Thereafter, the casting 31 in the mold 20 is cooled by radiational cooling wherein the mold 20 is emitting heat toward the water-cooled ring 51.

As described above, in the third embodiment, the mold 20 is rapidly cooled by the pressure gas jetted from the perforated pipe 53*a* disposed outside the area where the mold 20 is disposed, and from the perforated pipe 53*b* disposed inside the area where the mold 20 is disposed, when the mold 20 is drawn out from the heating chamber 10, and thereby the molten metal 32 is directionally solidified. A cooling effect obtained when the molten metal 32 is directionally solidified is heightened by constructing the directional solidification casting apparatus 100 in this way and by allowing the pressure gas from the perforated pipes 53*a* and 53*b* to rapidly cool the mold 20. Additionally, the casting 31 that has been directionally solidified does not easily generate structural defects even if it is a portion having a complex shape. Still additionally, since rapid cooling is carried out by the pressure gas jetted from the outer periphery side and from the inner periphery side of the mold 20, the cooling homogeneity of the molten metal 32 can be improved.

Fourth Embodiment

A fourth embodiment will hereinafter be described with reference to FIG. 7.

Figure 7:
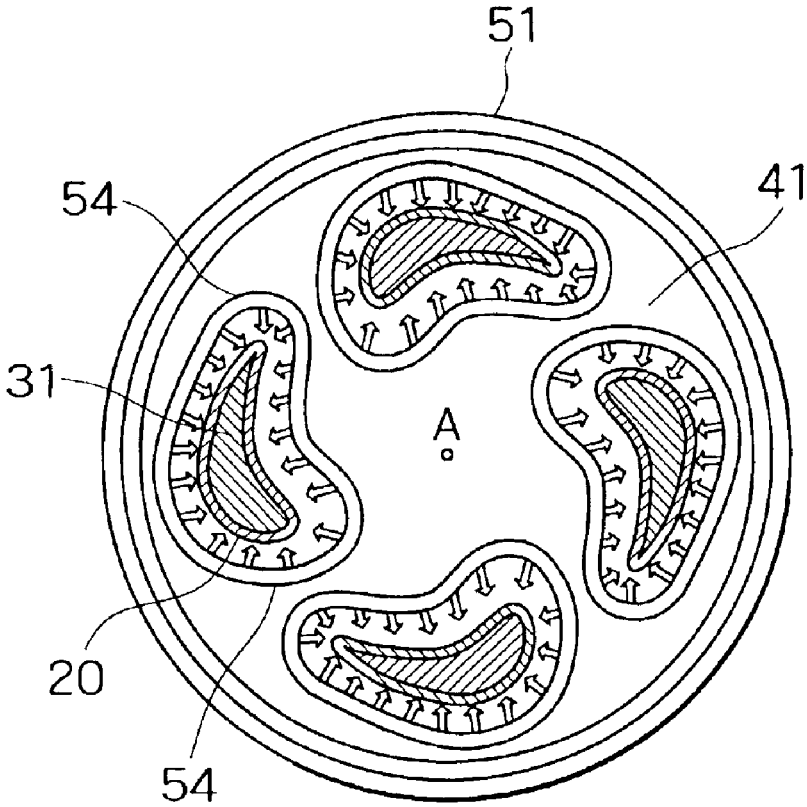
FIG. 7 is a plane cross-sectional view of the directional solidification casting apparatus 100 in a fourth embodiment.
Figure 8:
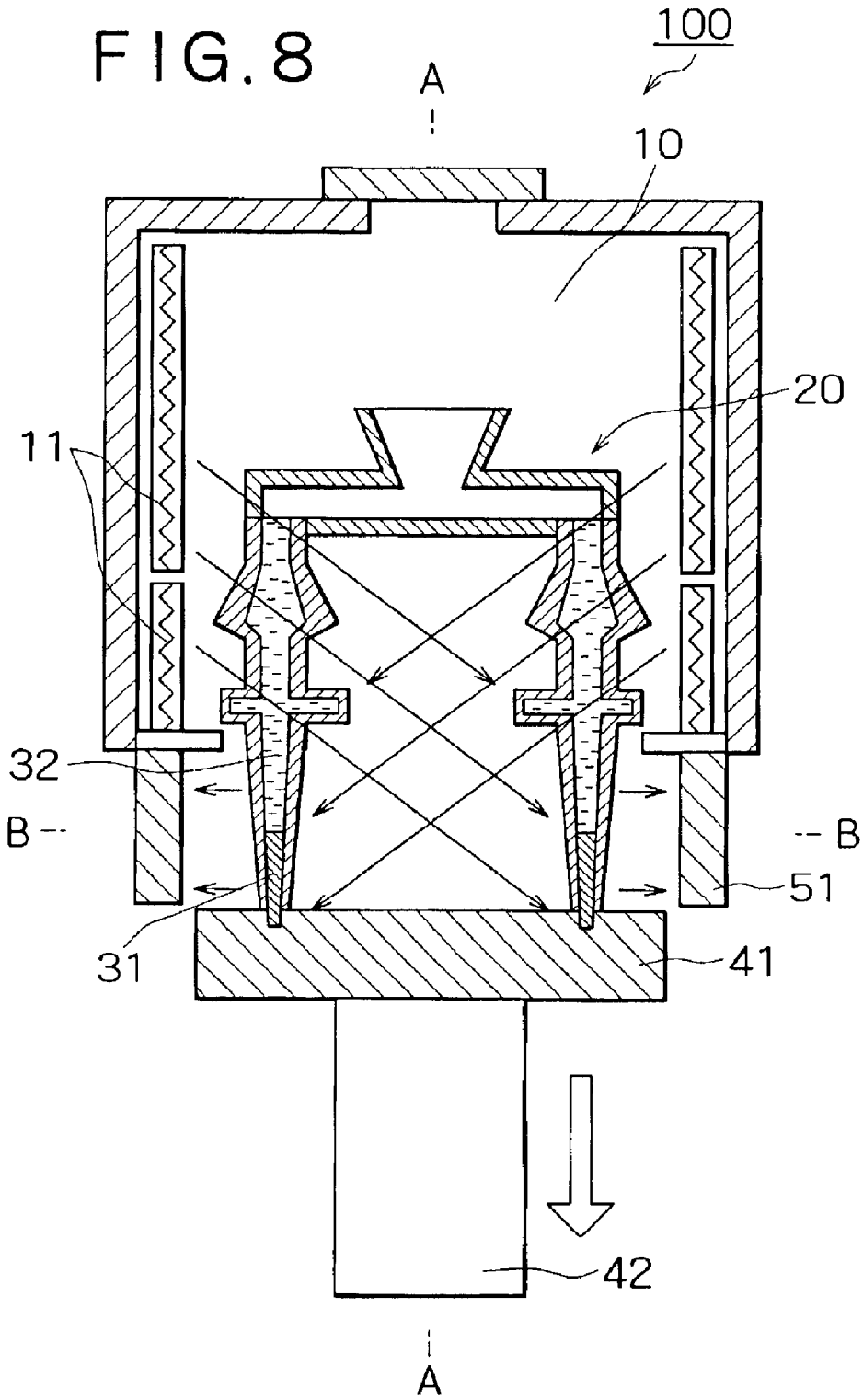
FIG. 8 shows the structure of a conventional directional solidification casting apparatus 100.

FIG. 7 is a plane cross-sectional view of the directional solidification casting apparatus 100 in the fourth embodiment. The plane cross-sectional view of FIG. 7 shows a state where the directional solidification casting apparatus 100 described in the third embodiment is cut along, for example, the line BB. Except that a ring 54 surrounding the outer periphery of the mold 20 is provided instead of the perforated pipes 53*a* and 53*b* shown in FIG. 5, the directional solidification apparatus 100 in the fourth embodiment has the same structure as the directional solidification casting apparatus 100 described in the third embodiment. Herein, let it be considered that the ring 54 is a ring-shaped tube surrounding the mold 20, and that gas ports with even pitches or uneven pitches are formed in the inner circumferential surface of the ring-shaped tube.

As shown in FIG. 7, the mold 20 is disposed in a predetermined area in such a way so as to surround the axial line A—A. The water-cooled ring 51 is disposed at the side of the outer periphery of the mold 20, and absorbs radiant heat from the mold 20, thereby cooling the mold 20. A pressure gas is jetted from the gas ports formed in the inner circumferential surface of the ring 54 disposed in such a way so as to surround the outer periphery of the mold 20 as shown by the arrows. The molten metal 32 in the mold 20 is rapidly cooled by this pressure gas, and is directionally solidified into the casting 31. Thereafter, the casting 31 in the mold 20 is cooled by radiational cooling wherein the mold 20 is emitting heat toward the water-cooled ring 51.

As described above, in the fourth embodiment, the mold 20 is rapidly cooled by the pressure gas jetted from the gas ports formed in the inner circumferential surface of the ring 54 disposed in such a way so as to surround the outer periphery of the mold 20 when the mold 20 is drawn out from the heating chamber 10, and thereby the molten metal 32 is directionally solidified. The same effect as in the third embodiment can be obtained by this structure in the fourth embodiment. Additionally, according to the fourth embodiment, since cooling can be carried out from all directions of the outer periphery of the mold 20, cooling homogeneity can be further improved.

In the fourth embodiment, a description has been given of a form in which the mold 20 is surrounded by the ring-shaped tube. However, the ring 54 is not necessarily required to be formed by a single tube, and a plurality of tubes may be integrated with each other to be a ring-shaped one. Additionally, the inner circumferential surface of the ring 54 shown in FIG. 7 is a curved surface, but, depending on the shape of the mold 20, it is preferable to appropriately change the shape of the ring 54 so as to be suitable for cooling the mold 20.

What is claimed is:

1. A directional solidification casting apparatus for directionally solidifying molten metal supplied to a plurality of molds by drawing out the plurality of molds disposed around a predetermined area from a heating chamber heated at or above a melting temperature of the metal to be cast, comprising:

a driver by which the plurality of molds are drawn out from the heating chamber, a first cooler by which the plurality of molds are cooled from inside the predetermined area with a cooling gas, and a second cooler by which the plurality of molds are cooled from outside the predetermined area with a cooling gas, wherein the first and second coolers planarly jet a cooling gas so as to strike the mold.

2. The directional solidification casting apparatus according to claim 1, further comprising a baffle which is disposed at a lower part of the heating chamber and at upper parts of the first and second coolers and has an opening through which the plurality of molds pass, wherein the baffle is disposed at the lower part of the heating chamber and at the upper parts of the first and second coolers even when the plurality of molds are drawn out from the heating chamber, and the baffle blocks heat emitted from a heat source of the heating chamber.

3. The directional solidification casting apparatus according to claim 1, further comprising:

a first radiational cooler passing through the driver, for absorbing radiant heat from the plurality of molds from inside of the driver and cooling the plurality of molds when the plurality of molds are lowered by the driver, and a second radiational cooler disposed outside the first radiational cooler, for absorbing radiant heat from the plurality of molds from outside of the driver and cooling the plurality of molds when the plurality of molds are lowered by the driver.

4. A directional solidification casting method for directionally solidifying molten metal supplied to a plurality of molds by drawing out the plurality of molds disposed around a predetermined area from a heating chamber heated at or above a melting temperature of the metal to be cast, comprising steps of:

drawing out the plurality of molds from the heating chamber, while blocking heat from the heating chamber, and jetting an inert gas from inside and outside of the plurality of molds disposed around the predetermined area so as to cool the molds, thereby directionally solidifying the molten metal, wherein the inert gas is planarly jetted onto the mold.

5. The directional solidification casting method according to claim 4, wherein the inert gas is atomized liquid nitrogen or an evaporated gas of liquid nitrogen.

* * * * *